US009981780B2

(12) United States Patent
Delasalle

(10) Patent No.: US 9,981,780 B2
(45) Date of Patent: May 29, 2018

(54) DEVICE FOR CLOSING BAGS OR THE LIKE, HAVING IMPROVED TACTILE AND SOUND EFFECTS, RESULTANT BAG, AND PRODUCTION METHOD

(71) Applicant: S2F FLEXICO, Henonville (FR)

(72) Inventor: William Delasalle, Cresnes (FR)

(73) Assignee: S2F FLEXICO, Henonville (FR)

( * ) Notice: Subject to any disclaimer, the term of this patent is extended or adjusted under 35 U.S.C. 154(b) by 307 days.

(21) Appl. No.: 14/389,960

(22) PCT Filed: Apr. 2, 2013

(86) PCT No.: PCT/EP2013/056938
§ 371 (c)(1),
(2) Date: Oct. 1, 2014

(87) PCT Pub. No.: WO2013/150027
PCT Pub. Date: Oct. 10, 2013

(65) Prior Publication Data

US 2015/0067993 A1 Mar. 12, 2015

(30) Foreign Application Priority Data

Apr. 3, 2012 (FR) ..... 12 53041

(51) Int. Cl.
*B65D 33/16* (2006.01)
*B65D 33/25* (2006.01)

(52) U.S. Cl.
CPC ..... *B65D 33/2508* (2013.01); *B65D 33/255* (2013.01); *B65D 33/2558* (2013.01); *Y10T 24/45168* (2015.01)

(58) Field of Classification Search
CPC ..... B65D 33/2508; B65D 33/255; B65D 33/2558; Y10T 24/2532; Y10T 24/2534; Y10T 24/2536; Y10T 24/2538; Y10T 24/45168
See application file for complete search history.

(56) References Cited

U.S. PATENT DOCUMENTS 3,557,413 A * 1/1971 Engle ..... A44B 18/0053 24/584.1
5,067,210 A * 11/1991 Keyaki ..... A44B 18/0053 24/442
5,067,822 A * 11/1991 Wirth ..... B31B 19/90 156/66

(Continued)

*Primary Examiner* — Jason W San
(74) *Attorney, Agent, or Firm* — Womble Bond Dickinson (US) LLP

(57) ABSTRACT

The present invention relates to a device for closing bags or the like, including two complementary profile members (A, B), characterized in that each of the two complementary profile members includes at least two profiled attachment elements (112, 114, 116, 118) for which form a multiple closure, in that said profiled elements for attachment have flattened portions (300) distributed over the length thereof, and in that said profiled attachment elements are supported by at least one respective support mat (102, 104) on which said profiled attachment elements are integrally formed, wherein the support mat is to be attached onto a support wall (500) and has a width (14) that is greater than the total width (13) of the profiled attachment elements.

14 Claims, 7 Drawing Sheets

(56) References Cited

Figure 1:
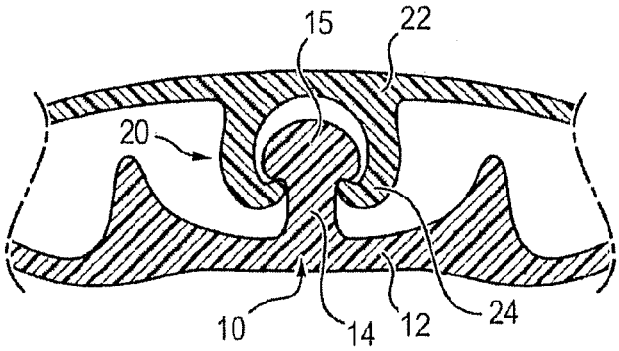
FIG. 1 Prior art

U.S. PATENT DOCUMENTS 5,070,584 A * 12/1991 Dais ..... B29C 67/0044 24/400
5,138,750 A * 8/1992 Gundlach ..... B65D 33/255 24/403
5,140,727 A * 8/1992 Dais ..... B65D 33/255 24/400
5,238,306 A * 8/1993 Heintz ..... B31B 19/90 383/210
5,509,734 A * 4/1996 Ausnit ..... B65D 33/2558 24/DIG. 50
5,564,834 A * 10/1996 Porchia ..... B65D 33/20 383/211
5,617,770 A * 4/1997 May ..... B26F 1/12 29/410
5,722,128 A * 3/1998 Toney ..... B65D 33/2591 24/399
5,962,040 A * 10/1999 Dais ..... B26F 1/12 425/290
6,594,872 B2 * 7/2003 Cisek ..... B29D 5/10 24/389
6,786,712 B2 * 9/2004 Cisek ..... B29D 5/10 264/210.2
7,213,305 B2 * 5/2007 Stolmeier ..... B31B 19/90 24/389
7,322,747 B2 * 1/2008 Borchardt ..... B65D 33/2541 24/30.5 R
7,478,950 B2 * 1/2009 Plourde ..... B65D 33/2541 24/30.5 R
7,543,361 B2 * 6/2009 Borchardt ..... B65D 33/2541 24/399
7,611,284 B2 * 11/2009 Borchardt ..... B65D 33/2541 24/585.12
7,674,039 B2 * 3/2010 McMahon ..... B65D 33/20 383/103
7,674,040 B2 * 3/2010 Dowd ..... B65D 33/2508 383/61.2
7,784,160 B2 * 8/2010 Dais ..... B65D 33/2508 24/585.12
7,886,412 B2 * 2/2011 Dais ..... B65D 81/2023 24/399
8,061,898 B2 * 11/2011 Pawloski ..... B65D 33/01 24/399
8,192,085 B2 * 6/2012 Pawloski ..... B65D 33/2558 383/35
8,197,138 B2 * 6/2012 Turvey ..... B65D 33/2508 383/101
8,272,107 B2 * 9/2012 Turvey ..... B65D 33/01 24/30.5 R
8,469,594 B2 * 6/2013 Gerbault ..... B65D 33/2533 24/399
8,550,716 B2 * 10/2013 Smith ..... B65D 33/255 383/63
8,568,031 B2 * 10/2013 Price ..... B65D 33/255 24/400
8,578,572 B2 * 11/2013 Ackerman ..... B65D 33/255 24/585.12
8,622,616 B2 * 1/2014 Petkovsek ..... B65D 33/255 24/399
8,727,620 B2 * 5/2014 Dais ..... B65D 33/2508 24/399
8,734,016 B2 * 5/2014 Borchardt ..... B29C 55/08 383/105
8,974,118 B2 * 3/2015 Pawloski ..... B65D 33/255 24/399
8,999,219 B2 * 4/2015 Plourde ..... B29D 5/10 264/299
9,015,910 B2 * 4/2015 Septien Rojas .... B65D 33/2541 24/399
9,103,114 B2 * 8/2015 Kojima ..... E04B 1/803
9,114,914 B2 * 8/2015 Dais ..... B65D 33/28
9,193,505 B2 * 11/2015 Kosub, Sr. ..... B65D 33/255
9,260,225 B2 * 2/2016 Anzini ..... B29D 5/10
2003/0033694 A1 * 2/2003 Cisek ..... B29D 5/10 24/401
2005/0271308 A1 * 12/2005 Pawloski ..... B65D 33/2508 383/63
2006/0168776 A1 * 8/2006 Dais ..... B65D 33/2541 24/401
2009/0300891 A1 * 12/2009 Nanba ..... B65D 33/2508 24/399
2010/0209020 A1 * 8/2010 Delasalle ..... B65D 33/2508 383/64
2011/0044566 A1 * 2/2011 Fish ..... B65D 33/007 383/63
2011/0211777 A1 * 9/2011 Gerbault ..... B65D 33/2533 383/63
2012/0106875 A1 * 5/2012 Pawloski ..... B65D 33/255 383/64
2013/0305500 A1 * 11/2013 Septien Rojas .... B65D 33/2541 24/586.11
2014/0093195 A1 * 4/2014 Dais ..... B65D 33/28 383/65
2014/0294325 A1 * 10/2014 Anzini ..... B65D 33/2508 383/63
2015/0043840 A1 * 2/2015 Bois ..... B65D 33/25 383/61.2

* cited by examiner

FIG. 16bis

DEVICE FOR CLOSING BAGS OR THE LIKE, HAVING IMPROVED TACTILE AND SOUND EFFECTS, RESULTANT BAG, AND PRODUCTION METHOD

The present invention relates to the field of closing devices for bags, sacs or the like.

Figure 2:
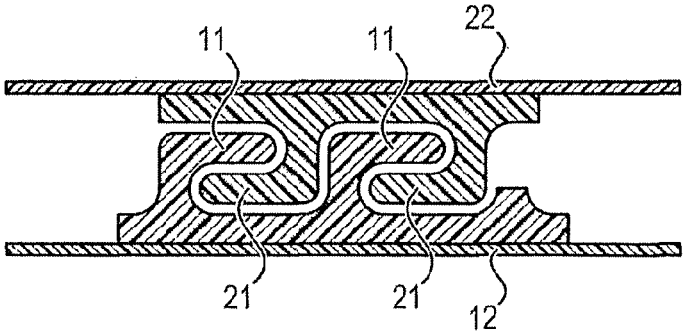
FIG. 2 Prior art

More precisely, the present invention relates to closing devices based on two complementary profile members 10, 20 carried on respective opposite support walls 12, 22, as shown by way of non-limiting examples in appended FIGS. 1 and 2.

Numerous variant embodiments of the devices illustrated in FIGS. 1 and 2 have already been proposed and fall within the field of the present invention.

FIG. 1 illustrates an exemplary embodiment according to which the aforementioned complementary profile members are made up of complementary male/female members, the male member including a stem 14 integral with the wall 12 and equipped with a widened protuberance 15 at its top, while the female member 20 consists of a groove 24 with convergent edges having in cross-section a cavity complementary to the protuberance 15.

FIG. 2 represents another variant embodiment according to which the complementary profile members 10, 20 consist of hooks 11 and 21.

The general aim of the present invention is to propose improvements to such known profile members so as to generate a tactile sensation and a sound effect during closing and opening of the aforementioned device, that is respectively during engagement of profile members 10, 20 and separation thereof.

Different arrangements have already been proposed in order to generate such tactile sensations and sound effects during closing and opening of the aforementioned device.

Figure 3:
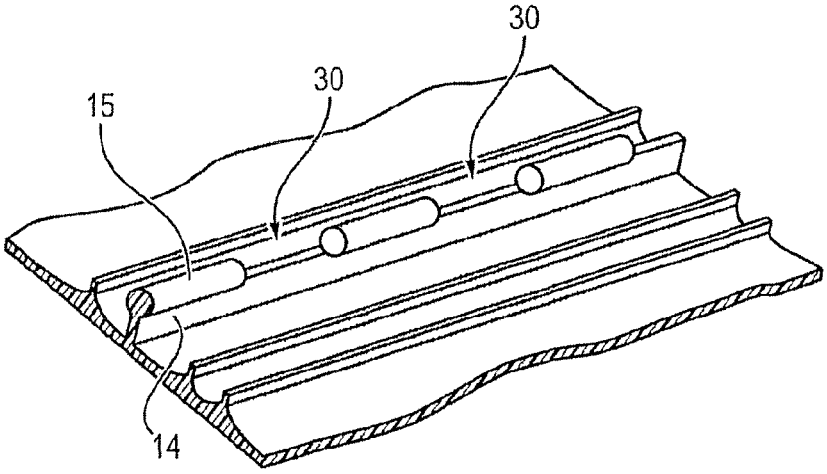
FIG. 3 Prior art

Examples of such known arrangements are described in documents WO96/28063, U.S. Pat. No. 5,070,584, EP 0446760, EP 0510797 and U.S. Pat. No. 5,007,146. As can be seen in the appended FIG. 3, the known arrangement usually consist of creating a periodic deformation or cutout 30 along one of the two profile members, for example the male profile member 10 as illustrated in FIG. 3, so as to thus define a succession of hard points and weak points in the respective engagement of the members 10, 20.

The means thus proposed do indeed allow the generation of a certain tactile and acoustic effect. The effects thus obtained thanks to the means hitherto proposed remain limited, however.

In this context, the particular goal of the present invention is to improve the known arrangements of the prior art, so as to reinforce the tactile sensation and the sound effect.

This goal is attained within the scope of the present invention thanks to a closure device for bags or the like including two complementary profile member assemblies, characterized by the fact that each of the two complementary profile member assemblies includes at least two profiled attachment elements forming a multiple closure, that these profiled attachment elements have a sequential crushings distributed over their length and that said profiled attachment elements are carried by at least one respective support mat whereon they are integrally formed, the support mat being designed to be fixed on one support mat having a width greater than the total width of the profiled attachment elements.

The Applicant has determined that the very specific triple combination in conformity with the present invention including 1) multiplication of the closure members, 2) sequential crushings and 3) the support mat integrally formed with the attachment elements, generates an improved effect compared with the prior art, thanks to a resonance phenomenon initiated at the attachment elements and propagated in vibratory mode at the support mat, leading to an amplification effect.

The present invention also relates to bags or sacks equipped with such a closure device.

The present invention also relates to a method form making such closure devices or bags including a sequential crushings step.

According to other advantageous features of the invention:

two support mats are provided, integrally formed with the attachment elements, respectively on either side thereof, the width of each mat is less than five times the width of the profiled attachment elements, preferably, the width of each mat is on the order of twice the width of the profiled attachment elements, the part of the support mat located facing the profiled attachment elements has a convex shape domed outward from the closure, the thickness of the support mat facing the profiled attachment elements is greater than the thickness of the mat on the outside of the profiled attachment elements, the closure is implemented in polyethylene or polypropylene, the pitch of the sequential crushings is comprised between 2 and 7.5 mm.

Figure 4:
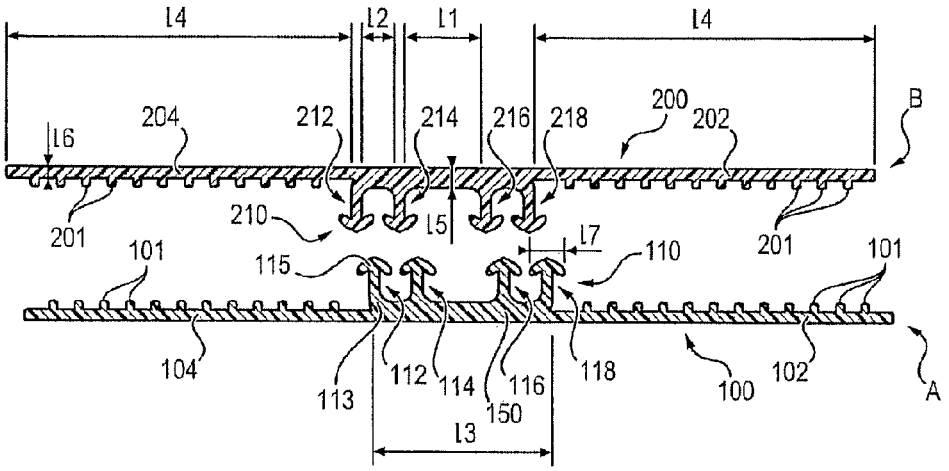
Figure 5:
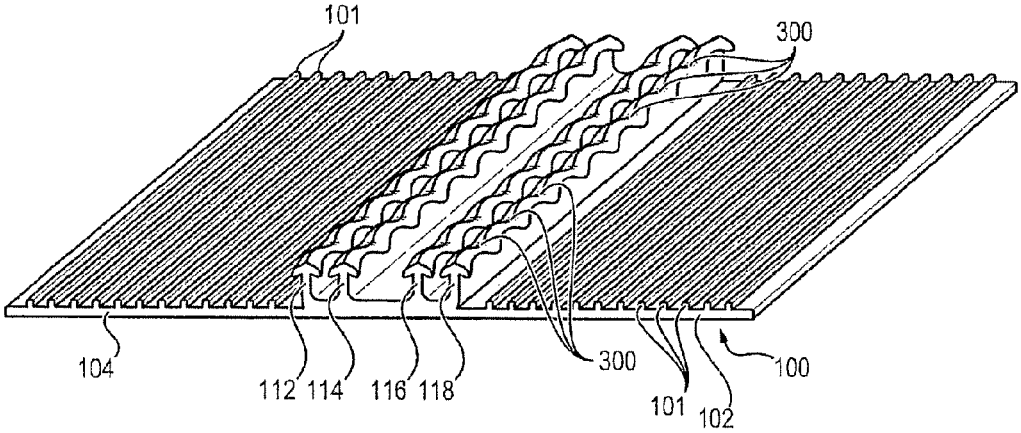
Figure 6:
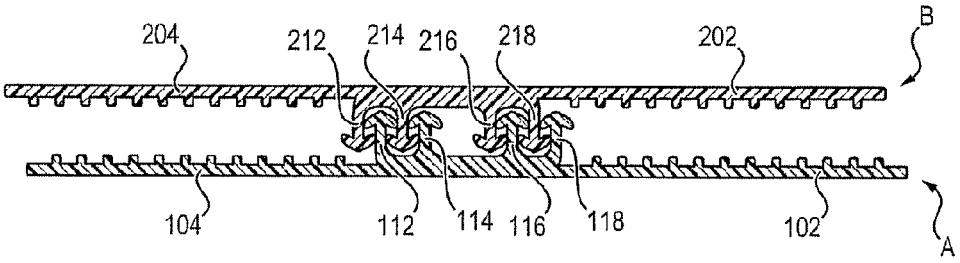
Figure 9:
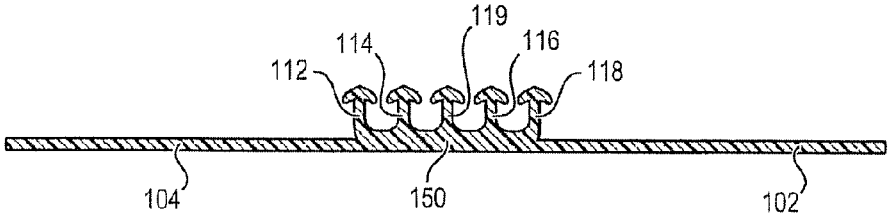
Figure 10:
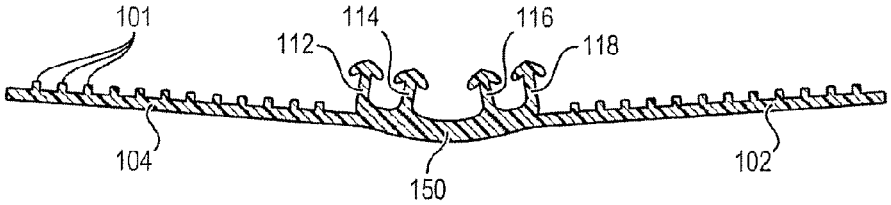
Figure 11:
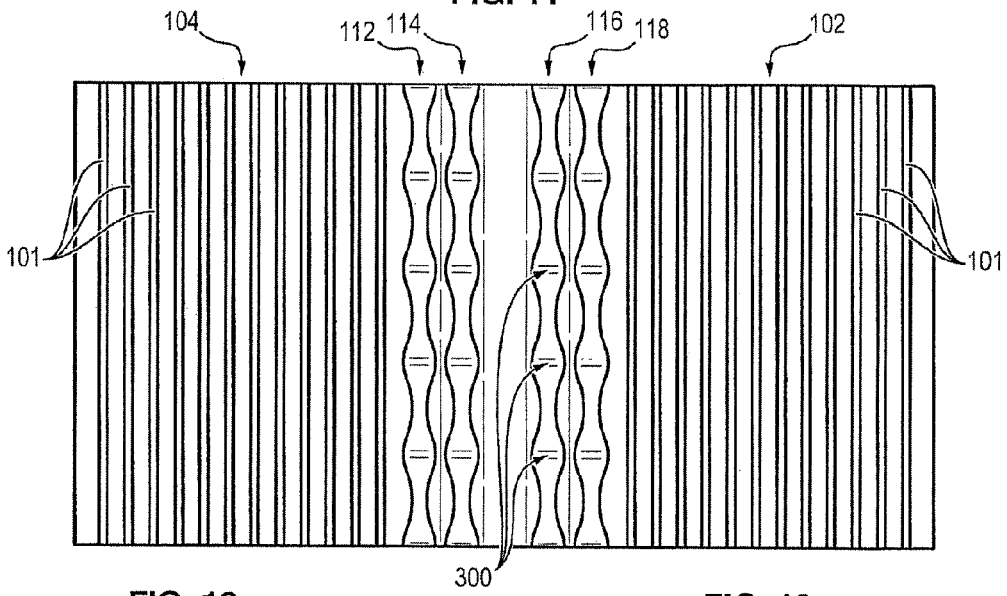
Figure 12:
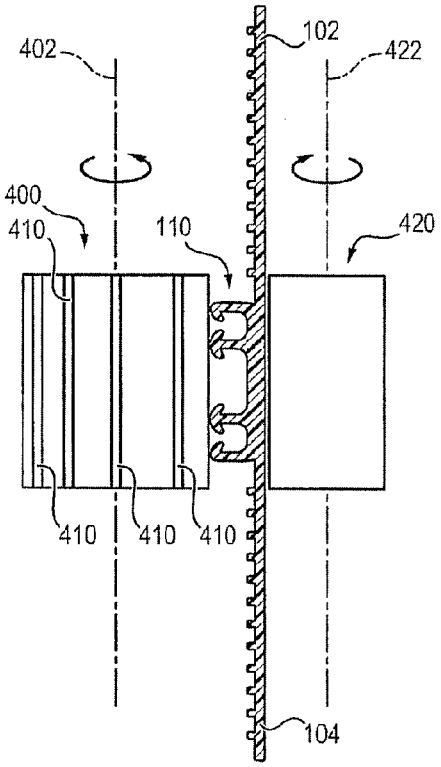
Figure 13:
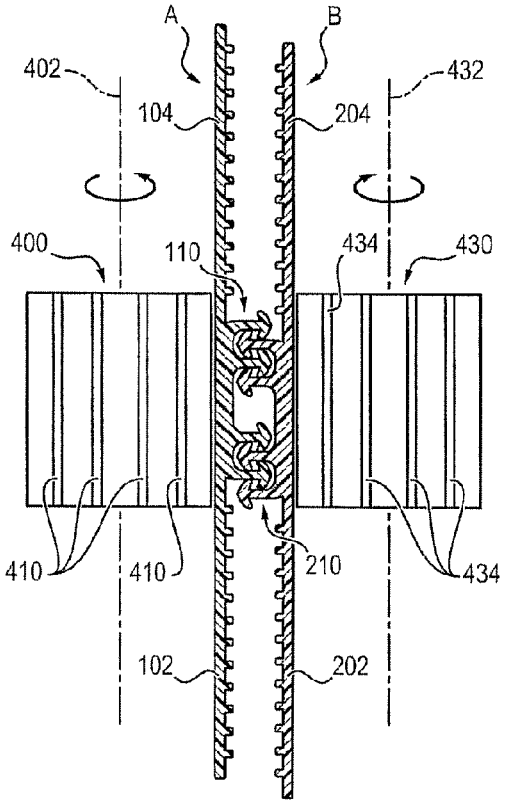
Figure 14:
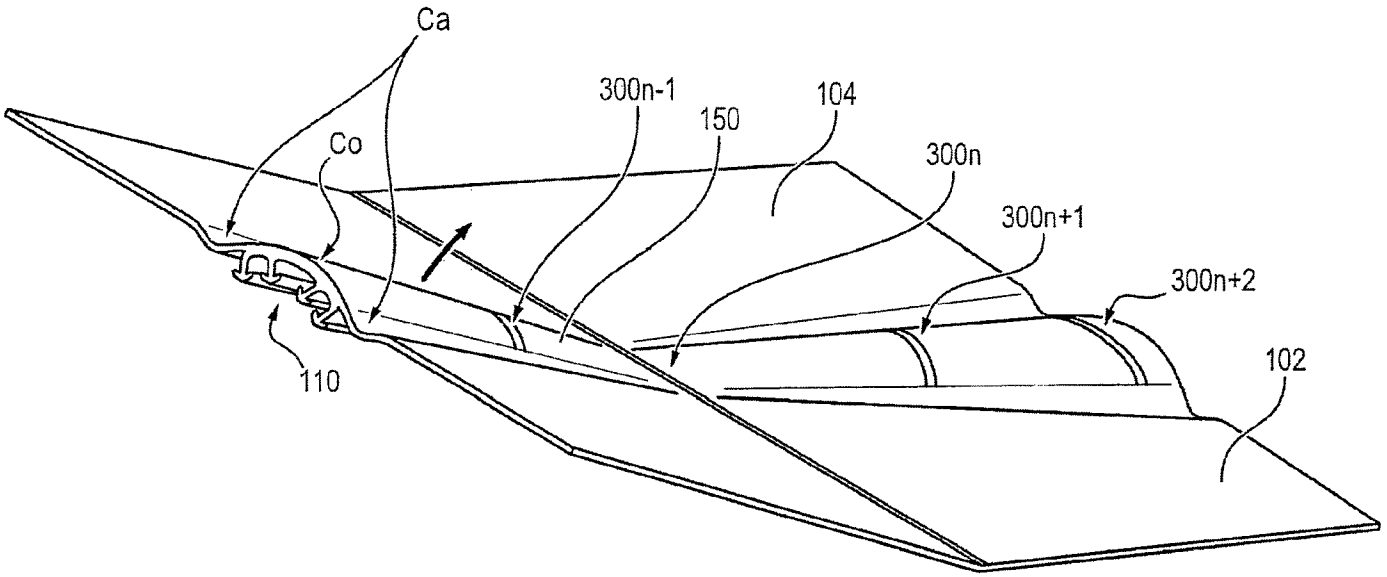
Figure 15:
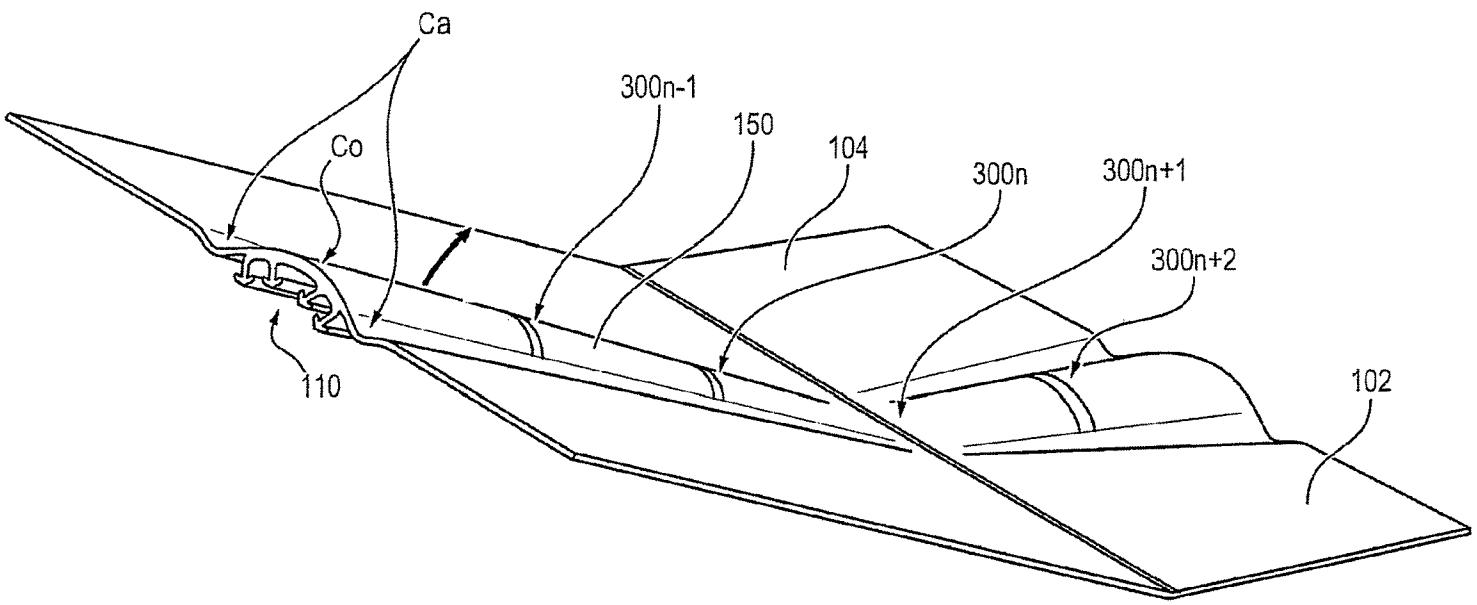
Figure 16:
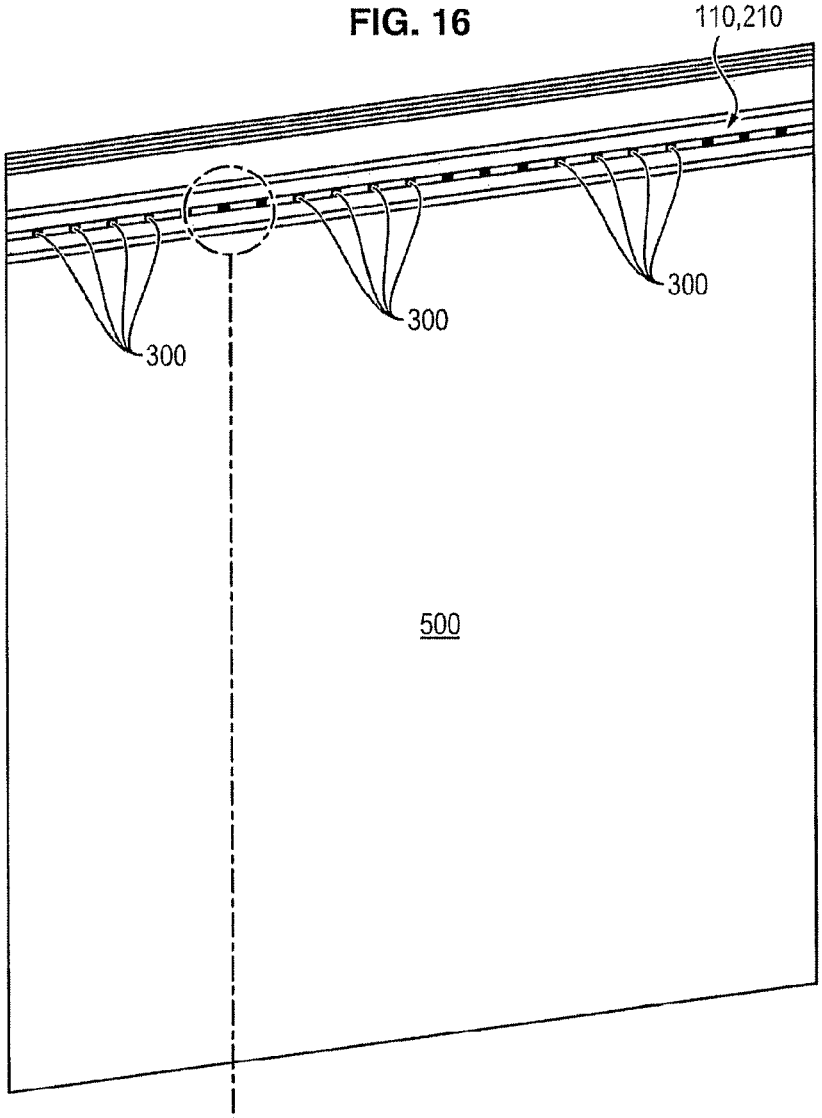
Figure 16:
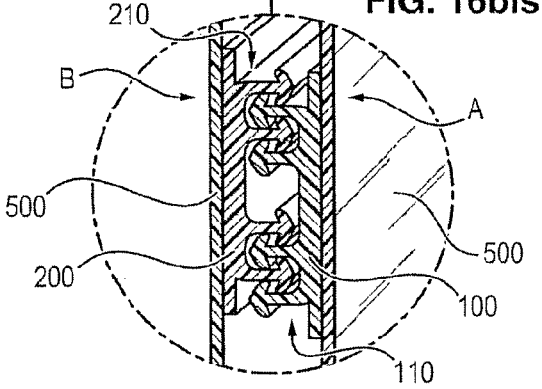

Other features, goals and advantages of the present invention will appear upon reading the detailed description which follows, and with regard to the appended drawings, given by way of non-limiting examples and wherein:

FIGS. 1 and 2, described previously, show a cross-section view of a closure device in conformity with two variant embodiments of the prior art, capable of being used within the scope of the present invention, FIG. 3 shows a partial perspective view of a closure device having periodic cutouts conforming to the prior art, FIG. 4 shows a schematic cross-section view of a closure device conforming to a first variant embodiment of the present invention, FIG. 5 shows a partial perspective view of the same closure device, illustrating more precisely the sequential crushings conforming to the present invention, FIG. 6 shows a schematic view of the closure device illustrated in FIG. 4, in the closed position, that is in the position with the two attachment member assemblies assembled, FIGS. 7, 8, 9 and 10 show cross-section view of four variants of closure devices conforming to the present invention, FIG. 11 shows a plan view of the closure device illustrated in FIG. 5 and showing sequential crushings, FIGS. 12 and 13 show schematically, in a cross-section view of the closure device, two variant embodiments of tools capable of being used for making the closure device conforming to the present invention, FIGS. 14 and 15 illustrate schematically a tactile and acoustic effect reinforced thanks to the use of a closure device including a portion of domed support mat facing profiled attachment elements, and FIG. 16 shows a schematic perspective view of a bag conforming to the present invention, FIG. 16 showing more precisely a partial enlarged view of the multiple closure used for this bag, emphasizing the attachment of the closure, through support mats, to the film of the bag.

Shown on appended FIG. 4 is a closure device conforming to the present invention, including two complementary members A and B consisting of two parallel support mats 100, 200 respectively bearing one of two complementary profile member assemblies 110, 210.

As previously indicated, each of the two complementary profile member assemblies 110, 210, includes at least two profiled attachment elements forming a multiple closure.

More precisely, according to the non-limiting embodiment illustrated in FIG. 4, the two assemblies 110, 210 are symmetrical and each include four profiled attachment elements 112, 114, 116 and 118; 212, 214, 216 and 218. According to this FIG. 4, each of the profiled attachment elements 112, 114, 116 and 118; 212, 214, 216 and 218 consists of a profile member with a constant straight section along the entire closure, shaped like an arrowhead. Indeed, each of these profiled attachment elements includes a stem, for example 113, generally orthogonal to a mat 100 or 200 and integral with a mat 100 or 200 provided, at its free end opposite to the mat 100 or 200, with an enlarged head, for example 115. The enlarged head 115 can be symmetrical with respect to the median plane of the stem 113 orthogonal to the mat 100 or 200, or asymmetrical with respect to said median plane. Advantageously, the facets of the enlarged head 115 oriented toward the support mats 100 or 200 converge at least slightly toward the respective support mat, away from the stem 113, so as to form undercuts which reinforce the mutual attachment of the profile members 112, 114, 116 and 118; 212, 214, 216 and 218 provided respectively on the two mats 100 and 200.

More precisely, according to the particular embodiment shown in FIG. 4, the 4 profiled attachment elements 112, 114, 116 and 118; 212, 214, 216 and 218 are distributed into two groups of two members 112 and 114 on the one hand, 116 and 118 on the other hand; respectively 212 and 214 on the one hand, 216 and 218 on the other hand. There exists between these two groups (112 and 114 on the one hand, 116 and 118 on the other hand) a gap 11 greater than the gap 12 existing between the two profiled attachment elements (112 and 114) of one and the same group. The first group of profiled attachment elements 112, 114 integral with a first mat 100 is designed to cooperate, as can be seen in FIG. 6, with the first group of profiled attachment elements 212, 214 integral with the second mat 200, while the second group of profiled attachment elements 116, 118 integral with the first mat 100 is designed to cooperate with the second group of profiled attachment elements 216, 218 integral with the second mat 200. To this end, the gap 12 between the two profiled attachment elements (112 and 114 for example) of one and the same group is designed to allow the insertion of an opposite attachment profile member (214 for example), while allowing its subsequent withdrawal, by elastic deformation of the material, if a sufficient pull-out force is applied between the mats 100 and 200.

By way of a non-limiting example, the gap 12 between the two profiled attachment elements (112 and 114 for example) of one and the same group can be on the order of 1 mm, while the gap 11 between the two groups of profiled attachment elements can be on the order of 3 to 4 mm.

The total width 13 or transverse dimension of the profiled attachment elements, corresponding to the distance separating the outside surfaces of the outermost stems, can thus be on the order of 6 mm.

As a variant, the two attachment profile member assemblies 110 and 210 can be asymmetrical.

As indicated previously, within the scope of the present invention the profiled attachment elements are periodically flattened along the entire closure.

As will be explained in detail hereafter, the flattening of the two complementary profile members 110, 210 generate a series of hard points and weak points during the engagement and the separation of the members A and B of the closure.

The pitch of the flattening is preferably comprised between 2 and 7.5 mm, for example on the order of 2.5 mm.

In FIG. 5, the flattening is shown schematically under reference symbol 300.

The making of such a sequential crushings will be described later on.

Moreover, as was also previously indicated, according to the present invention, the profiled attachment elements 112, 114, 116 and 118; 212, 214, 216 and 218 are carried by support mats 100, 200 formed integrally, the width whereof is greater than the total width 13 of the profiled attachment elements.

More precisely, according to the invention, preferably, two support mat segments 102, 104 and 202, 204 are thus provided on either side of the profiled attachment elements and each having a width 14 less than five times the total width 13 of the profiled attachment elements.

More precisely, also preferably, the width 14 of each mat segment 102, 104 and 202, 204 is on the order of twice the width 13 of the profiled attachment elements.

It will also be noted, on examining FIG. 4, that preferably the thickness 15 of the support mat facing the profiled attachment elements is greater than the thickness 16 of the mat on the outside of the profiled attachment elements.

The thickness 15 of the support mat facing the profiled attachment elements can thus be on the order of twice the thickness 16 of the mat on the outside of the profiled attachment elements.

The closure can be implemented in any appropriate, preferably polyolefin-based, materials. Advantageously, these are polyethylene or polypropylene.

As indicated earlier, the Applicant has determined that the very specific previously mentioned triple combination conforming to the present invention and including 1) multiplication of the closure members 112, 114, 116 and 118; 212, 214, 216 and 218, 2) sequential crushings 300 and 3) the support mat 100, 200 integrally formed with the attachment elements 112, 114, 116 and 118; 212, 214, 216 and 218, generates an effect that is improved compared to the prior art, thanks to a resonance phenomenon initiated at the attachment elements 112, 114, 116 and 118; 212, 214, 216 and 218 and propagated in vibratory mode at the support mat 100, 200 through the thick base of the mat located facing the attachment elements 112, 114, 116 and 118; 212, 214, 216 and 218, leading to an amplification effect.

The closure conforming to the present invention does indeed allow the generation of a sound effect greater than that obtained with a conventional closure conforming to the prior art.

It will be noted that the profile member sections 102, 104, 202 and 204 located on the outside of the profiled attachment elements can comprise, on their inner surfaces or their outer surfaces, ribs 101, 201 facilitating manipulation of the closure.

The complementary closure profile members 110 and 210 exhibit, prior to sequential crushings, a constant cross-section over their length. They are preferably made by extrusion.

The geometry of the profiled attachment elements 112, 114, 116 and 118; 212, 214, 216 and 218 can be the subject of numerous embodiments.

Certain of these variants are illustrated in the appended FIGS. 7 to 10.

Figure 7:
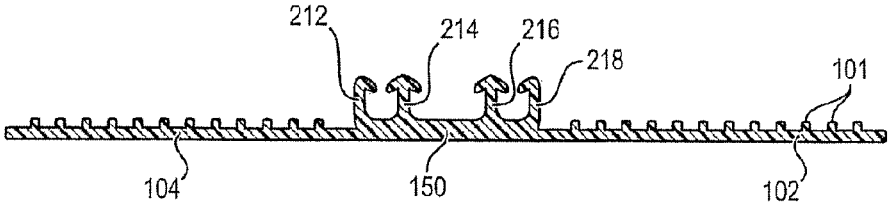

The embodiment of FIG. 7 differs from the embodiment illustrated in FIG. 6 in that the outermost profiled attachment elements 112, 118 and 212, 218 are not shaped like arrowheads but rather like hooks, concave toward the center of the closure.

Figure 8:
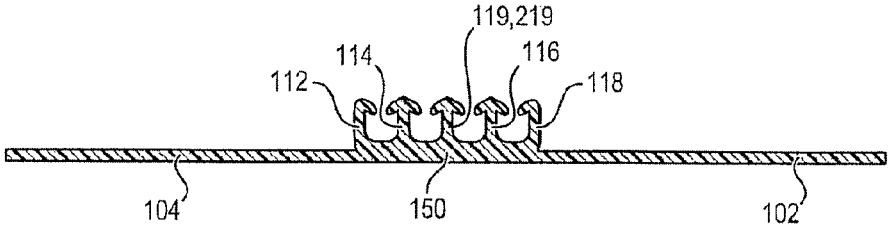

The embodiment of FIG. 8 differs from the embodiment illustrated in FIG. 7 in that an additional arrowhead-shaped attachment member 119, 219 is provided in the center of each closure member, so that each closure member thus includes 5 profiled attachment elements 112, 114, 119, 116 and 118; 212, 214, 219, 216 and 218 evenly distributed in width, the outermost members hook-shaped and the others arrowhead-shaped.

The embodiment of FIG. 9 differs from the embodiment illustrated in FIG. 4 in that, comparably to FIG. 8, an additional arrowhead-shaped attachment member 119, 219 is provided at the center of each closure member, so that each closure member includes 5 arrowhead-shaped profiled attachment elements 112, 114, 119, 116 and 118; 212, 214, 219, 216 and 218, evenly distributed in width.

The embodiment illustrated in FIG. 10 differs from the embodiments previous described in that the part 150 of the support web located facing the profiled attachment elements 112, 114, 116 and 118; 212, 214, 216 and 218 has a domed shape, convex toward the outside of the closure. The domed geometry of the central portion 150 of the support web, convex outward, is generally accompanied by an adjacent transition portion of the mats themselves 102, 104 and 202, 204, inversely concave outward, as can be seen in FIGS. 14 and 15. In FIGS. 14 and 15, the central convex outward domed portion is designated Co, while the adjacent portions of the concave outward mats are designated Ca. The segments of mats 102, 104 and 202, 204 outside these concave portions Ca are generally flat.

This domed geometry of the support mat makes it possible to reinforce the tactile and acoustic effect generated during opening, and to a certain extent during engagement, of the closure. The effect resulting from this crowning is shown schematically in FIGS. 14 and 15.

In these FIGS. 14 and 15 have been shown the locations of sequential crushings 300 along the base portion 150 of the closure. A person skilled in the art will understand, upon examining FIGS. 14 and 15, that during an attempted opening, that is separation of the two closure members A and B, the geometry of the base 150 of the support mat (and this, even for the concave portions Ca of the mats), changes from a domed section over most of the length of the closure and a generally rectilinear section at the last flattened portion 300*n* of the profiled attachment elements still engaged. And when this flattened portion 300*n*, formerly rectilinear and formerly engaged between members A and B, releases under the influence of the pull between the members A and B, the central portion 150 of the closure, located at the zone 300*n*, suddenly becomes convex again (conversely, the portions of the mats located at the zone 300*n*, and which coincide with the otherwise concave portions Ca, suddenly become concave again), while the following flattened portion 300*n*+1 becomes rectilinear, and so on over the length of the closure, thus contributing to the tactile and acoustic effect.

According to yet another variant conforming to the present invention, it is possible to combine the different embodiments illustrated in FIGS. 4 and 7 to 10, in that the member A of the closure can conform to any one of these embodiments while the other member B of the same closure conforms to another embodiment.

Within the scope of the present invention, the closure device including the two closure profile members 110, 210 is made separately from a bag, then applied and bonded, by thermal welding for example, onto the films 500 constituting a bag.

The Applicant has observed that the interface thus defined, between the surface of the support mats 100, 200 and the facing surface of the films 500 of the bag, makes it possible to confine the vibrations, generated by the sequential crushings during opening, within the support mats 100, 200 or at the very least to limit the propagation of these vibrations within the films 500, and thus to accentuate the tactile and acoustic effect compared with the prior art.

As previously indicated, within the scope of the present invention, the complementary profile members 110, 210 are periodically flattened along the entire length of the closure with a flattening pitch comprised between 2 and 7.5 mm, for example on the order of 2.5 mm.

The flattening means can be the subject of various embodiments.

FIGS. 5 and 11 illustrate flattening zones 300 obtained on the peaks of the profiled attachment elements 112, 114, 116 and 118; 212, 214, 216 and 218 and covering the entire width 17 of the profile members, considered perpendicular to their lengthwise direction.

Preferably, the two members A and B are subject to identical flattening with identical pitch.

As shown in FIG. 12, the sequential crushings can be accomplished, within the scope of the present invention, separately on each individual member A and B of the closures. Thus what is shown on FIG. 12 is flattening of a profiled attachment elements using a ribbed roller 400 with peripheral protrusions 410 having the desired pitch for the sequential crushings 300, pressing on one side of the closure device, preferably on the side of the attachment elements, and a simple backup roller 420, located on the opposite side, that is preferably on the outer face of the support mats. The roller 400 and backup roller 420 are guided or driven in rotation, about respective axes of rotation 402, 422 parallel to one another and to the support mats and perpendicular to the direction of movement of the closure, by any appropriate means.

As a variant, as shown in FIG. 13, the sequential crushings can be accomplished within the scope of the present invention, simultaneously on both members A and B of the closure when these members A and B are engaged. Thus what is shown in FIG. 13 is the simultaneous flattening of the profiled attachment elements of both members A and B using two ribbed rollers 400, 430 with peripheral protrusions 410, 434 with the pitched desired for the sequential crushings 300, respectively located on either side of the closure. Rollers 400, 430 are guided or driven in rotation, about respective axes of rotation 402, 432, parallel to one another and to the support mats and perpendicular to the direction of movement of the closure, by any appropriate means. This variant of the present invention makes it possible to obtain a considerable periodic deformation of the two complementary profile members 110, 210 while still ensuring their ability to engage and separate, inasmuch as the flattening 300 that is accomplished is perfectly complementary, because it is accomplished with the two profile members in the closed position.

The ribs provided on the rollers for accomplishing flattening are advantageously of a generally domed shape to avoid shearing the material of the flattened profile members, and to avoid removing matter in said profile members during flattening. The ribs provided on the rollers are thus designed to form the flattened portions in the shape of waves with continuously-changing curvature, as seen for example in FIG. 5. The Applicant has determined that this arrangement makes it possible to obtain a closure which, in the closed state, has sealing properties with regard to fluids, whether gaseous or liquid, greater than those of closures conforming to the prior art.

Both rollers 400, 430 are preferably synchronized so that their respective protrusions simultaneously press on the profile members 110, 210 to flatten them.

It is observed in FIG. 11 that the sequential crushings leads to periodic flaring of the attachment elements in width transversely to the lengthwise direction.

When, as illustrated in FIG. 13, the sequential crushings is accomplished according to the present invention in the assembled position of the members A and B, it is ensured that the cross-sections of the profiled attachment elements, while distorted in the widening sense, remain perfectly matched, complementary to a certain degree and compatible both for closure, that is for being put into engagement, and opening, that is separation.

It will be noted that the presence of closure segments with constant cross-section between two flattened portions 300, and hence the ease of engagement of these segments between two flattened portions 300 makes it possible, by simply sliding between the fingers of a user, to extend the engagement obtained at such constant cross-section segments toward the deformed flattened portions 300.

Reinforcement of the tactile sensation and of the sound effect obtained thanks to the present invention results in particular from the transmission of vibrations to the support mats while confining said vibrations within the support mats.

The Applicant has in fact observed that the sound and tactile effect was considerably attenuated when similar sequential crushings was accomplished on closure profile members integrally formed directly on the films 500 constituting the bag.

Within the scope of the present invention, the flattening is preferably carried out so that an enlargement is obtained, in the direction of the width 17 of the profile members, equal to at least 5% of the original width 17, preferably greater than 10% of said width 17.

The flattening rollers 400, 430, and the backup roller 420 if any, can be heated in order to reinforce the deformation by flattening of the closure profile members and ensure that they are kept in their periodically flattened position.

However, if the material allows it, the flattening can be accomplished using simple rollers 400, 430 at ambient temperature.

According to yet another variant, the sequential crushings can be accomplished with rollers at ambient temperature, but operating on a "softened" closure, that is one deformed by hot extrusion, directly after extrusion.

FIG. 16 illustrates a bag conforming to the present invention. Seen in FIG. 16 is a series of flattened portions distributed over the length of the closure device.

Of course, the present invention is not limited to the particular embodiments which have just been described, but extends to any variation conforming to its spirit.

The Applicant has also observed that the invention makes it possible to obtain a remarkably fluid-tight closure device compared to the prior art. Besides its previously mentioned features, a good seal is obtained particularly when the height of the flattened portions is less than the total height of the profile members, and even more precisely when the height of the flattened portions is less than the height of the flared head 115. Indeed, the stem 113 of the profile members is thereby protected. And the assured cooperation between the flattened heads of the facing profile members put into engagement, combined with the plurality of stems which must be bypassed, in the closed position of a bag, to pass from the inside of a bag to the outside, forms an effective labyrinth constituting an effective seal with regard to fluids contained in the bags, whether said fluids are gaseous or liquid.

The invention claimed is:

1. A bag comprising support walls and a closure device including two complementary profile members, wherein each of the two complementary profile members includes at least two profiled attachment elements forming a multiple closure, and a support mat, wherein the support mat of each of the two complementary profile members is fixed to a corresponding support wall of the bag, wherein the attachment elements comprise sequential crushings distributed over their length, wherein each attachment element comprises a stem, wherein outside surfaces of the outermost stems of the attachment elements are separated by a distance, said distance defining a total width of the multiple closure, wherein the support mat comprises a base integral with the attachment elements, and a support web, said attachments and said support web being integral with the base and extending from one of the outermost stems of the attachment elements, wherein the support web has a width greater than the total width of the respective multiple closure.

2. The bag according to claim 1, wherein the support mat comprises two support webs integral with the corresponding base, wherein one of the support webs extends from a first side of the base while the other of the support webs extends from a second side of the base.

3. The bag according to claim 1, wherein the width of each support web is less than five times the total width of the corresponding multiple closure.

4. The bag according to claim 1, wherein the width of each support web is twice the total width of the corresponding multiple closure.

5. The bag according to claim 1, wherein the base has a domed shape that is convex to the outside of the closure.

6. The bag according to claim 5, wherein a portion of each support web located immediately outside the multiple closure and adjacent to the aforementioned convex outward domed base has a shape that is concave to the outside of the closure.

7. The bag according to claim 1, wherein a thickness of the base is greater than a thickness of the support web.

8. The bag according to claim 1, wherein the closure is made of polyethylene or polypropylene.

9. The bag according to claim 1, characterized in that a pitch of the sequential crushings is comprised between 2 and 7.5 mm.

10. The bag according to claim 1, wherein the complementary profile members each include four attachment elements.

11. The bag according to claim 10, wherein the at least two attachment elements are distributed in groups of two.

12. The bag according to claim 1, wherein the complementary profile members each include five attachment elements.

13. The bag according to claim 1, wherein the attachment elements are arrowhead-shaped or hook-shaped.

14. The bag according to claim 1, wherein the sequential crushing is accomplished in the form of waves with continuous variation of curvature and over a crushing height less than a height of the profile members and more precisely still preferably over a crushing height less than the height of a flared head.

* * * * *